US007205269B2

(12) United States Patent
Sadlowski et al.

(10) Patent No.: US 7,205,269 B2
(45) Date of Patent: Apr. 17, 2007

(54) LAUNDRY DETERGENT COMPOSITIONS WITH HUEING DYE

(75) Inventors: Eugene Steven Sadlowski, Cincinnati, OH (US); Michael David Cummings, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/170,656

(22) Filed: Jun. 29, 2005

(65) Prior Publication Data

US 2005/0288207 A1 Dec. 29, 2005

Related U.S. Application Data

(60) Provisional application No. 60/583,745, filed on Jun. 29, 2004.

(51) Int. Cl.
*C11D 17/00* (2006.01)

(52) U.S. Cl. ..... 510/419; 510/343; 510/349

(58) Field of Classification Search ..... 510/340, 510/349, 373, 419
See application file for complete search history.

(56) References Cited

U.S. PATENT DOCUMENTS 3,154,489 A * 10/1964 Du Brow et al. ..... 424/70.19
3,454,494 A * 7/1969 Clark et al. ..... 510/333
3,660,286 A * 5/1972 Sepulveda ..... 510/515
3,892,669 A * 7/1975 Rapisarda et al. ..... 510/525
4,308,061 A * 12/1981 Iwahashi et al. ..... 106/31.43
4,367,071 A * 1/1983 Mizuno et al. ..... 503/201
5,130,035 A 7/1992 Dell'Armo, et al.
5,861,447 A * 1/1999 Nagasawa et al. ..... 523/161
2005/0079992 A1* 4/2005 Smith ..... 510/506
2005/0288206 A1* 12/2005 Sadlowski et al. ..... 510/392
2005/0288207 A1* 12/2005 Sadlowski et al. ..... 510/392

FOREIGN PATENT DOCUMENTS

DE 102 52 396 A1 5/2004

OTHER PUBLICATIONS

PCT International Search Report, 3 Pages, Mailed Oct. 6, 2005.

* cited by examiner

*Primary Examiner*—Douglas McGinty
*Assistant Examiner*—John M Petruncio
(74) *Attorney, Agent, or Firm*—Armina E. Matthews; Kim William Zerby

(57) ABSTRACT

Laundry detergent compositions comprise (a) surfactant, and (b) a hueing dye selected from triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, and mixtures thereof.

2 Claims, No Drawings

LAUNDRY DETERGENT COMPOSITIONS WITH HUEING DYE

CROSS REFERENCE TO RELATED APPLICATION

This Application claims the benefit of U.S. Provisional Application Ser. No. 60/583,745, filed Jun. 29, 2004 (P&G Case 9694P).

FIELD OF THE INVENTION

The present invention is directed to laundry detergent compositions, and, more particularly to laundry detergent compositions comprising a hueing dye which exhibits good fabric deposition to, for example, make yellow on white fabrics appear more white, and which avoids undesirable hueing dye build up which, for example, results in "bluing" of white fabrics.

BACKGROUND OF THE INVENTION

Wear and laundering of fabric articles, and particularly white fabric articles, can result in a discoloration from the original fabric color. For example, white fabrics which are repeatedly laundered can exhibit a yellowing in color appearance which causes the fabric to look older and worn. To overcome the undesirable yellowing of white fabrics, and similar discoloration of other light colored fabrics, some laundry detergent products include a hueing or bluing dye which attaches to fabric during the laundry wash and/or rinse cycle.

However, after repeated laundering of fabric with detergent containing bluing dye, the bluing dye tends to accumulate on the fabric, giving the fabric a bluish tint. Such repeated laundering of white fabric articles tends to give the articles a blue, rather than white, appearance. To combat this accumulation of bluing dyes on fabric, chlorine treatments have been developed. While the chlorine treatment is effective to remove accumulated bluing dyes, the chlorine treatment is an additional and often inconvenient step in the laundry process. Additionally, chlorine treatment involves increased laundering costs and is harsh on fabrics and therefore undesirably contributes to increased fabric degradation. Accordingly, a need exists for improved laundry detergents which can counter the undesirable yellowing of white fabrics, and similar discoloration of other light colored fabrics.

SUMMARY OF THE INVENTION

Accordingly, it is an object of the present invention to provide improved laundry detergent compositions. Further, it is an object of the present invention to provide laundry detergent compositions which can counter the undesirable yellowing of white fabrics, and similar discoloration of other light colored fabrics.

Generally, the invention is directed to a laundry detergent composition, comprising (a) surfactant, and (b) a hueing dye selected from triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, and mixtures thereof In further embodiments, the invention is directed to a method of laundering a fabric article, which method comprises washing the fabric article in a wash solution comprising a laundry detergent composition according to the invention. In additional embodiments, the invention is directed to methods of making such laundry detergent compositions.

The compositions and methods of the present invention are advantageous in providing improved hueing of fabric, including whitening of white fabric, while avoiding significant build up of bluing dyes on the fabric. Additional objects and advantages will be apparent in view of the detailed description of the invention.

DETAILED DESCRIPTION OF THE INVENTION

The laundry detergent compositions of the present invention may be in solid or liquid form, including a gel form. In one specific embodiment, the compositions are liquid in form and comprise heavy duty liquid compositions. The compositions comprise surfactant and a hueing dye selected from a defined group of dyes which have been found to exhibit good tinting efficiency during a laundry wash cycle without exhibiting excessive undesirable build up after laundering. Thus, undesirable bluing after repeated washings with the detergent compositions of the invention is avoided and costly and harsh chlorine treatments are unnecessary.

The laundry detergent composition comprises a surfactant in an amount sufficient to provide desired cleaning properties. In one embodiment, the laundry detergent composition comprises, by weight, from about 5% to about 90% of the surfactant, and more specifically from about 5% to about 70% of the surfactant, and even more specifically from about 5% to about 40%. The surfactant may comprise anionic, nonionic, cationic, zwitterionic and/or amphoteric surfactants. In a more specific embodiment, the detergent composition comprises anionic surfactant, nonionic surfactant, or mixtures thereof.

Anionic Surfactants

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Exemplary anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$–$C_{14}$, e.g., $C_{12}$, LAS is a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: $R'—O—(C_2H_4O)_n—SO_3M$ wherein R' is a $C_8$–$C_{20}$ alkyl group, n is from about 1 to 20, and M is a salt-forming cation. In a specific embodiment, R' is $C_{10}$–$C_{18}$ alkyl, n is from about 1 to 15, and M is sodium, potassium, ammonium, alkylammonium, or alkanolammonium. In more specific embodiments, R' is a $C_{12}$–$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoyxylated, e.g., non-ethoxylated, alkyl ether sulfate surfactants are those produced by the sulfation of higher $C_8$–$C_{20}$ fatty alcohols. Conventional primary alkyl sulfate surfactants have the general formula: $ROSO_3^-M^+$ wherein R is typically a linear $C_8$–$C_{20}$ hydrocarbyl group, which may be straight chain or branched chain, and M is a water-solubilizing cation. In specific embodiments, R is a $C_{10}$–$C_{15}$ alkyl, and M is alkali metal, more specifically R is $C_{12}$–$C_{14}$ and M is sodium.

Specific, nonlimiting examples of anionic surfactants useful herein include: a) $C_{11}$–$C_{18}$ alkyl benzene sulfonates (LAS); b) $C_{10}$–$C_{20}$ primary, branched-chain and random alkyl sulfates (AS); c) $C_{10}$–$C_{18}$ secondary (2,3) alkyl sulfates having formulae (I) and (II):

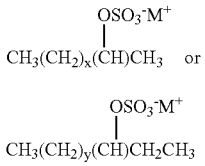

(I)

(II)

wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) $C_{10}$–$C_{18}$ alkyl alkoxy sulfates ($AE_xS$) wherein preferably x is from 1–30; e) $C_{10}$–$C_{18}$ alkyl alkoxy carboxylates preferably comprising 1–5 ethoxy units; f) mid-chain branched alkyl sulfates as discussed in U.S. Pat. No. 6,020,303 and U.S. Pat. No. 6,060,443; g) mid-chain branched alkyl alkoxy sulfates as discussed in U.S. Pat. No. 6,008,181 and U.S. Pat. No. 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548.; i) methyl ester sulfonate (MES); and j) alpha-olefin sulfonate (AOS).

Nonionic Surfactants

Suitable nonionic surfactants useful herein can comprise any of the conventional nonionic surfactant types typically used in liquid detergent products. These include alkoxylated fatty alcohols and amine oxide surfactants. Preferred for use in the liquid detergent products herein are those nonionic surfactants which are normally liquid.

Suitable nonionic surfactants for use herein include the alcohol alkoxylate nonionic surfactants. Alcohol alkoxylates are materials which correspond to the general formula: $R^1(C_mH_{2m}O)_nOH$ wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. In one embodiment, the alkoxylated fatty alcohols will also be ethoxylated materials that contain from about 2 to 12 ethylene oxide moieties per molecule, more preferably from about 3 to 10 ethylene oxide moieties per molecule.

Thet alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the traadenames Neodol and Dobanol by the Shell Chemical Company.

Another suitable type of nonionic surfactant useful herein comprises the amine oxide surfactants. Amine oxides are mateials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$–$C_{16}$ primary alkyl. R' is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of nonionic surfactants include: a) $C_{12}$–$C_{18}$ alkyl ethoxylates, such as, NEODOL® nonionic surfactants from Shell; b) $C_6$–$C_{12}$ alkyl phenol alkoxylates wherein the alkoxylate units are a mixture of ethyleneoxy and propyleneoxy units; c) $C_{12}$–$C_{18}$ alcohol and $C_6$–$C_{12}$ alkyl phenol condensates with ethylene oxide/propylene oxide block polymers such as Pluronic® from BASF; d) $C_{14}$–$C_{22}$ mid-chain branched alcohols, BA, as discussed in U.S. Pat. No. 6,150,322; e) $C_{14}$–$C_{22}$ mid-chain branched alkyl alkoxylates, $BAE_x$, wherein x 1–30, as discussed in U.S. Pat. No. 6,153,577, U.S. Pat. No. 6,020,303 and U.S. Pat. No. 6,093,856; f) Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; g) Polyhydroxy fatty acid amides as discussed in U.S. Pat. No. 5,332,528, WO 92/06162, WO 93/19146, WO 93/19038, and WO 94/09099; and h) ether capped poly(oxyalkylated) alcohol surfactants as discussed in U.S. Pat. No. 6,482,994 and WO 01/42408.

Anionic/Nonionic Combinations

In the laundry detergent compositions herein, the detersive surfactant component may comprise combinations of anionic and nonionic surfactant materials. When this is the case, the weight ratio of anionic to nonionic will typically range from 10:90 to 90:10, more typically from 30:70 to 70:30.

Cationic Surfactants

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine (APA).

Zwitterionic Surfactants

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, $C_8$ to $C_{18}$ (preferably $C_{12}$ to $C_{18}$) amine oxides and sulfo and hydroxy betaines, such as N-alkyl-N,N-diethylammino-1-propane sulfonate where the alkyl group can be $C_8$ to $C_{18}$, preferably $C_{10}$ to $C_{14}$.

Ampholytic Surfactants

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

Hueing Dye

The hueing dye is selected from triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, and mixtures thereof. These dyes have been found to exhibit good tinting efficiency during a laundry wash cycle without exhibiting excessive undesirable build up after laundering. The hueing dye is included in the laundry detergent composition in an amount sufficient to provide a tinting effect to fabric washed in a solution containing the detergent. In one embodiment, the detergent composition comprises, by weight, from about 0.0001% to about 0.05%, more specifically from about 0.001% to about 0.01%, of the hueing dye.

In a specific embodiment, the hueing dye is a triarylmethane basic blue dye or a triarylmethane basic violet dye. In a more specific embodiment, the hueing dye is a triarylmethane basic blue dye or a triarylmethane basic violet dye of the formula:

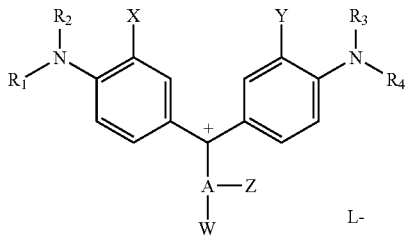

wherein A is phenyl, phenylene, naphthyl, or naphthylene; W is H or

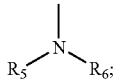

X, Y, and Z are independently H, Cl, Br, or a $C_{1-4}$ alkyl radical; $R_1$ through $R_6$ are independently H, or a $C_{1-12}$ alkyl, aryl, alkylaryl, alkoxy, or hydroxy alkyl radical; and L is a counterion. In a more specific embodiment, W is

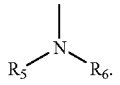

Exemplary triarylmethane basic blue dyes and triarylmethane basic violet dyes are set forth in Table 1:

TABLE 1

| CI name | CI constitution number | Structure |
|---|---|---|
| Basic Blue 1 | 42025 | 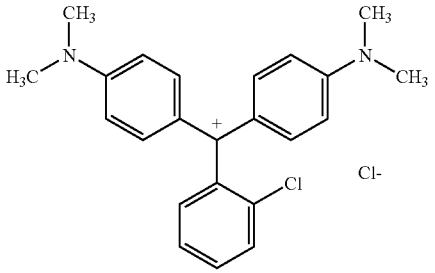 |

TABLE 1-continued
| CI name | CI constitution number | Structure |
|---|---|---|
| Basic Blue 5 | 42140 | 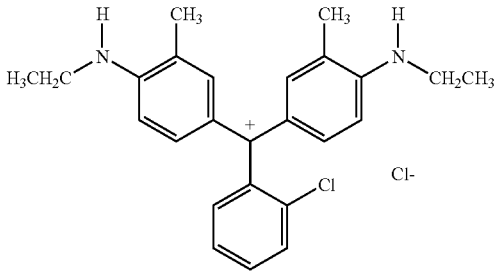 |
| Basic Blue 7 | 42595 | 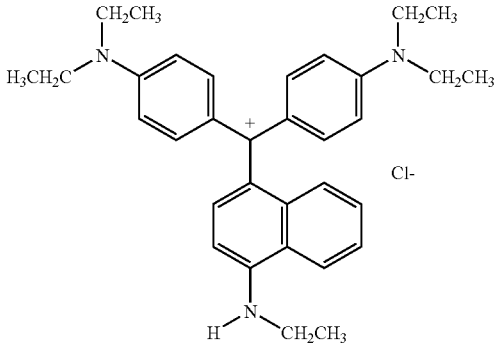 |
| Basic Blue 8 | 42563 | 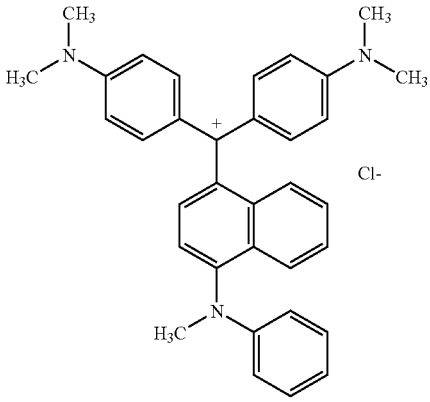 |
| Basic Blue 11 | 44040 | 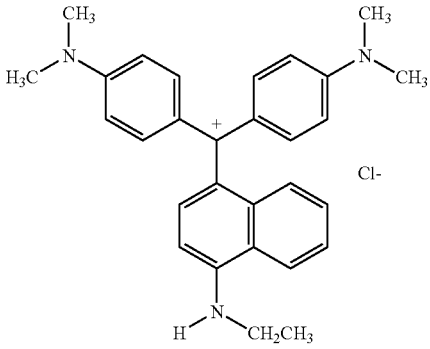 |

TABLE 1-continued
| CI name | CI constitution number | Structure |
|---|---|---|
| Basic Blue 15 | 44085 | 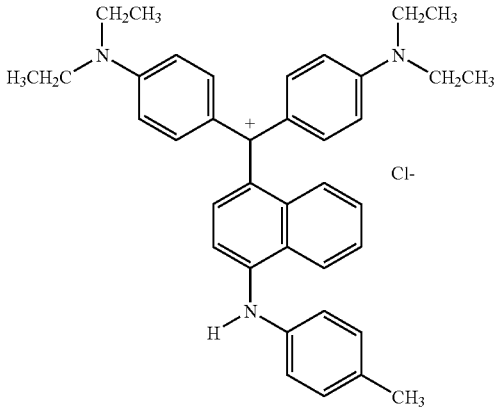 |
| Basic Blue 18 | 42705 | 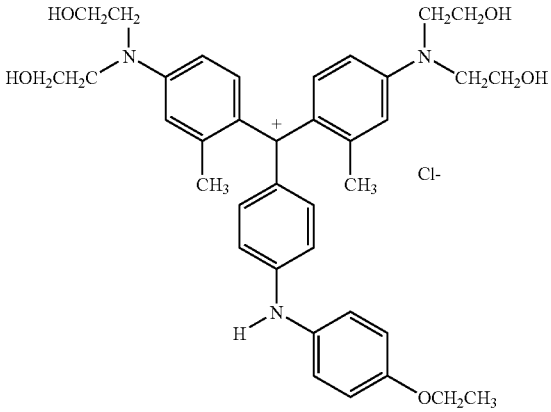 |
| Basic Blue 20 | 42585 | 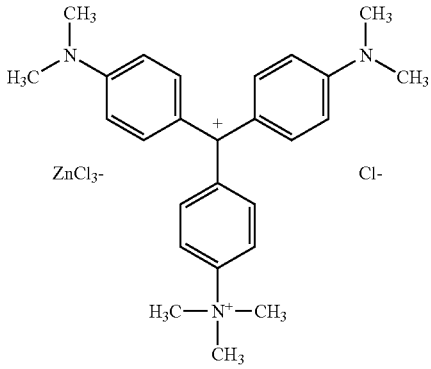 |
| Basic Blue 23 | 42140 | 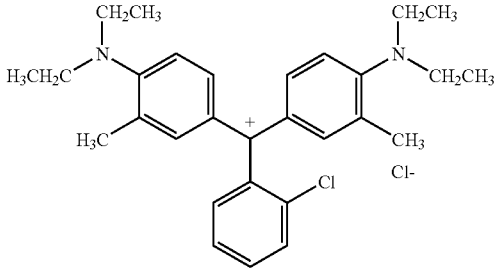 |

TABLE 1-continued
| CI name | CI constitution number | Structure |
|---|---|---|
| Basic Blue 26 | 44045 | 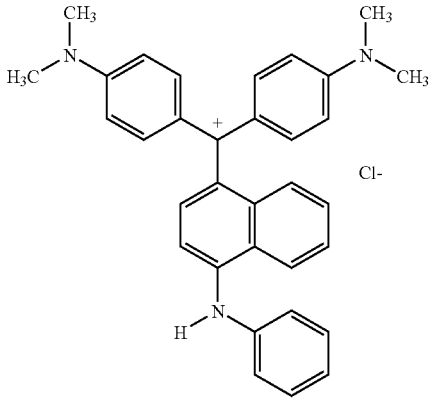 |
| Basic Blue 55 | 44044 | 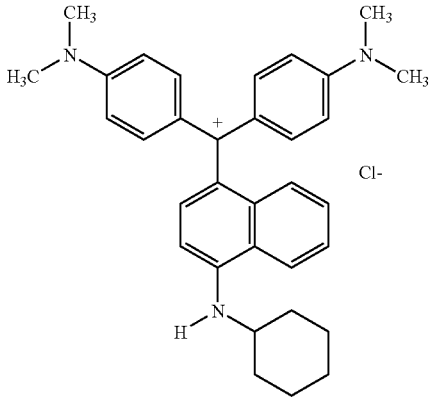 |
| Basic Blue 81 | 42598 | 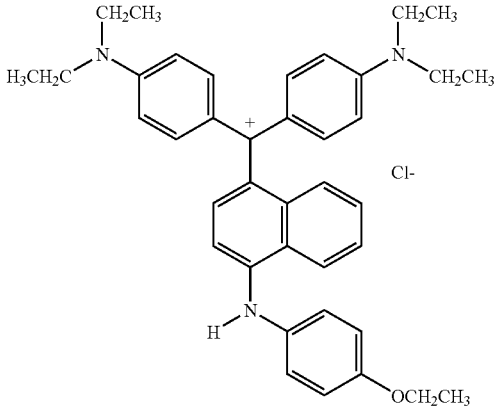 |
| Basic Violet 1 | 42535 | 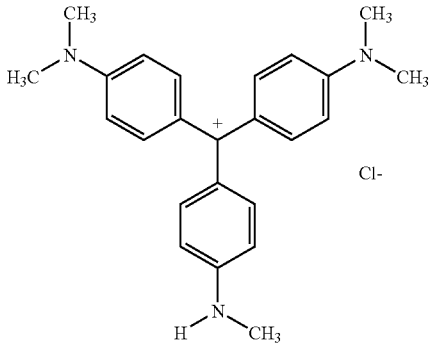 |

TABLE 1-continued
| CI name | CI constitution number | Structure |
|---|---|---|
| Basic Violet 2 | 42520 | 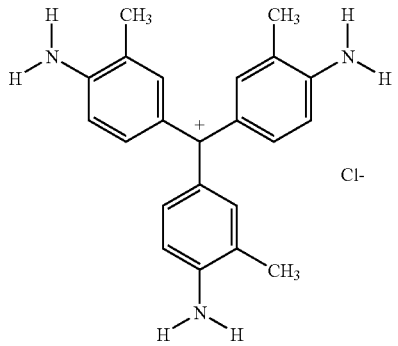 |
| Basic Violet 3 | 42555 | 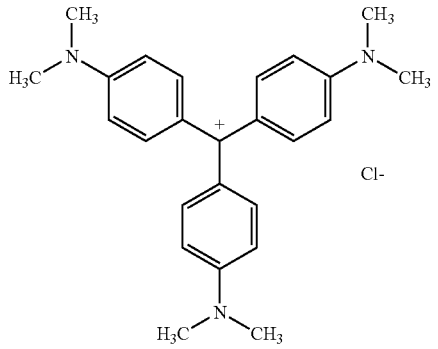 |
| Basic Violet 4 | 42600 | 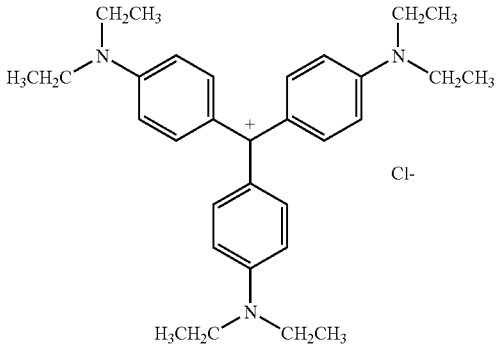 |
| Basic Violet 14 | 42510 | 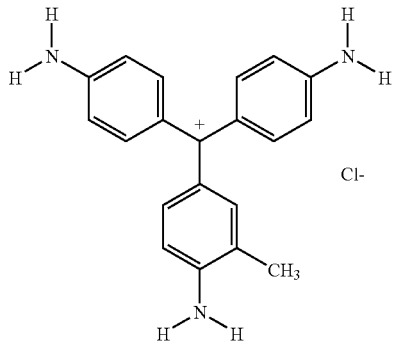 |

TABLE 1-continued

| CI name | CI constitution number | Structure |
|---|---|---|
| Basic Violet 23 | 42557 | 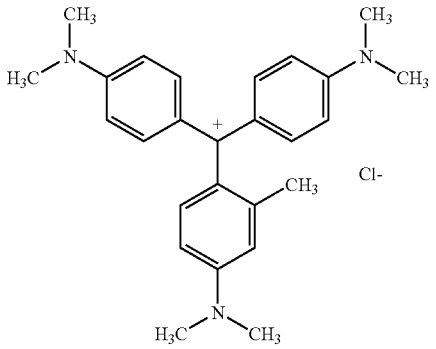 |

In further specific embodiments, the hueing dye is triarylmethane basic violet 3, or triarylmethane basic violet 4.

In a further embodiment, the hueing dye is a methine blue or violet basic dye of the formula

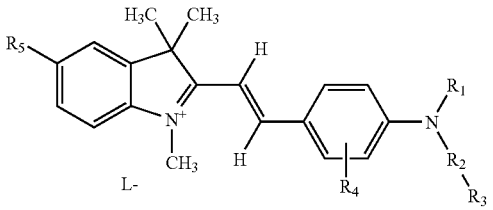

wherein $R_1$ is H or a $C_{1-4}$ alkyl radical; $R_2$ is H, or a $C_{1-12}$ alkyl, aryl, or alkylaryl radical; $R_3$ is H, OH, Cl, Br, or a $C_{1-4}$ alkoxy radical, or is absent; $R_4$ is OH, Cl, Br, or a $C_{1-4}$ alkyl or alkoxy radical, or is absent; $R_5$ is H or

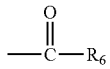

wherein $R_6$ is a $C_{1-4}$ alkyl or alkoxy radical; and L is a counterion. Examples of methine blue and violet basic dyes are set forth in Table 2:

TABLE 2

| CI name | CI constitution number | Structure |
|---|---|---|
| Basic Violet 7 | 48020 | 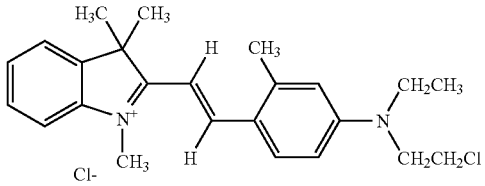 |
| Basic Violet 16 | 48013 | 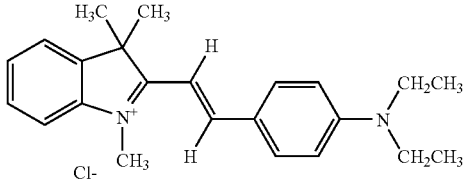 |

TABLE 2-continued

| CI name | CI constitution number | Structure |
|---|---|---|
| Basic Violet 21 | 48030 | 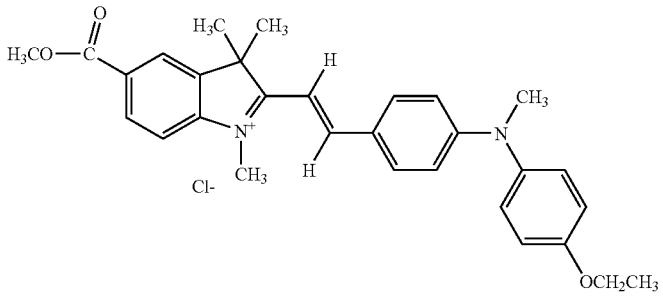 |

Another suitable methine dye is basic blue 69.

In another embodiment, the hueing dye is a basic blue anthraquinone dye or a basic violet anthraquinone dye. In a more specific embodiment, the hueing dye is a basic blue anthraquinone dye or a basic violet anthraquinone dye of the formula:

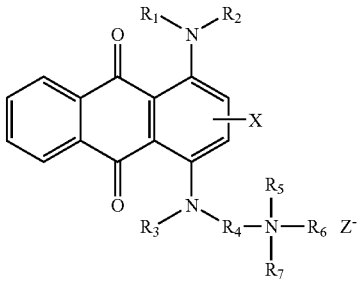

wherein R1, R2 and R3 are H or a 1–6 carbon alkyl radical. R4 is a 1–12 carbon alkylene, arylene or alkylarylene radical. R5 and R6 are 1–6 carbon alkylradicals. R7 is H, a 1–6 carbon alkyl radical or is absent. X is H, a halide or a 1–6 carbon alkyl radical. Z is a counterion.

Exemplary anthraquinone basic dyes include basic blue 21, 22, and 47 set forth in Table 3 and additionally basic blue 35 and basic blue 80:

TABLE 3

| CI name | CI constitution number | Structure |
|---|---|---|
| Basic Blue 21 | | 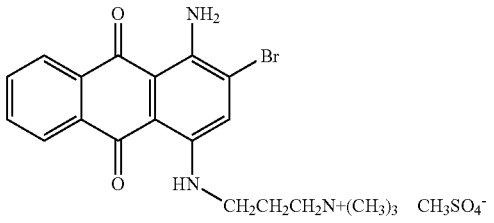 |
| Basic Blue 22 | 61512 | 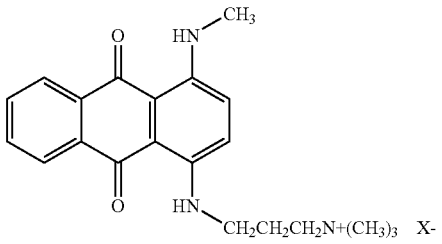 |

TABLE 3-continued

| CI name | CI constitution number | Structure |
|---|---|---|
| Basic Blue 47 | 61111 | 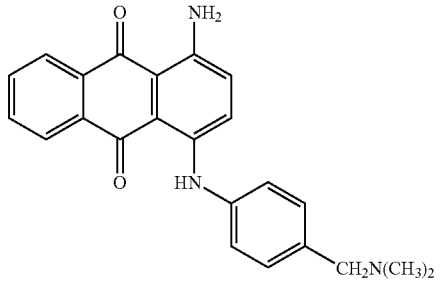 |

Other suitable dyes include the azo dyes basic blue 16, basic blue 65, basic blue 66, basic blue 67, basic blue 71, basic blue 159, basic violet 19, basic violet 35, basic violet 38, basic violet 48, oxazine dyes basic blue 3, basic blue 75, basic blue 95, basic blue 122, basic blue 124, basic blue 141, Nile blue A and xanthene dye basic violet 10, and mixtures thereof.

In one embodiment of the inventive detergent compositions, a non-hueing dye is also employed in combination with the hueing dye. The non-hueing dye may be non-substantive in nature. The combination of both a hueing dye and a non-hueing dye allows customization of product color and fabric tint.

As noted, the compositions may be in the form of a solid, either in tablet or particulate form, including, but not limited to particles, flakes, or the like, or the compositions may be in the form of a liquid. The liquid detergent compositions comprise an aqueous, non-surface active liquid carrier. Generally, the amount of the aqueous, non-surface active liquid carrier employed in the compositions herein will be effective to solubilize, suspend or disperse the composition components. For example, the compositions may comprise, by weight, from about 5% to about 90%, more specifically from about 10% to about 70%, and even more specifically from about 20% to about 70% of the aqueous, non-surface active liquid carrier.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such alkanols, diols, other polyols, ethers, amines, and the like, have been conventionally been added to liquid detergent compositions as co-solvents or stabilizers, for purposes of the present invention, the utilization of such water-miscible liquids should be minimized to hold down composition cost. Accordingly, the aqueous liquid carrier component of the liquid detergent products herein will generally comprise water present in concentrations ranging from about 5% to about 90%, more preferably from about 20% to about 70%, by weight of the composition.

The detergent compositions of the present invention can also include any number of additional optional ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 0.1% to about 50%, more preferably from about 1% to about 30%, by weight of the composition.

The liquid detergent compositions herein are in the form of an aqueous solution or uniform dispersion or suspension of surfactant, hueing dye, and certain optional other ingredients, some of which may normally be in solid form, that have been combined with the normally liquid components of the composition, such as the liquid alcohol ethoxylate nonionic, the aqueous liquid carrier, and any other normally liquid optional ingredients. Such a solution, dispersion or suspension will be acceptably phase stable and will typically have a viscosity which ranges from about 100 to 600 cps, more preferably from about 150 to 400 cps. For purposes of this invention, viscosity is measured with a Brookfield LVDV-II+ viscometer apparatus using a #21 spindle.

The liquid detergent compositions herein can be prepared by combining the components thereof in any convenient order and by mixing, e.g., agitating, the resulting component combination to form a phase stable liquid detergent composition. In a preferred process for preparing such compositions, a liquid matrix is formed containing at least a major proportion, and preferably substantially all, of the liquid components, e.g., nonionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, substantially all of any anionic surfactants and the solid form ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills, are incorporated. As a variation of the composition preparation procedure hereinbefore described, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

In an alternate embodiment for forming the liquid detergent compositions, the hueing dye is first combined with one or more liquid components to form a hueing dye premix, and this hueing dye premix is added to a composition formulation containing a substantial portion, for example more than 50% by weight, more specifically, more than 70% by weight, and yet more specifically, more than 90% by weight, of the balance of components of the laundry detergent composition. For example, in the methodology described above, both the hueing dye premix and the enzyme component are added at a final stage of component additions. In a further embodiment, the hueing dye is encapsulated prior to addition to the detergent composition, the encapsulated dye is suspended in a structured liquid, and the suspension is added to a composition formulation containing a substantial portion of the balance of components of the laundry detergent composition.

As noted previously, the detergent compositions may be in a solid form. Suitable solid forms include tablets and particulate forms, for example, granular particles or flakes. Various techniques for forming detergent compositions in such solid forms are well known in the art and may be used herein. In one embodiment, for example when the composition is in the form of a granular particle, the hueing dye is provided in particulate form, optionally including additional but not all components of the laundry detergent composition. The hueing dye particulate is combined with one or more additional particulates containing a balance of components of the laundry detergent composition. Further, the hueing dye, optionally including additional but not all components of the laundry detergent composition may be provided in an encapsulated form, and the hueing dye encapsulate is combined with particulates containing a substantial balance of components of the laundry detergent composition.

The compositions of this invention, prepared as hereinbefore described, can be used to form aqueous washing solutions for use in the laundering of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith. An effective amount of the liquid detergent compositions herein added to water to form aqueous laundering solutions can comprise amounts sufficient to form from about 500 to 7,000 ppm of composition in aqueous washing solution. More preferably, from about 1,000 to 3,000 ppm of the detergent compositions herein will be provided in aqueous washing solution. The present detergent compositions comprising surfactant and a hueing dye selected from a defined group of dyes have been found to exhibit good tinting efficiency during a laundry wash cycle without exhibiting excessive undesirable build up after laundering.

EXAMPLES

The following examples illustrate the compositions of the present invention but are not necessarily meant to limit or otherwise define the scope of the invention herein.

Example 1

The following liquid formulas are within the scope of the present invention.

| Ingredient | 1a wt % | 1b wt % | 1c wt % | 1d wt % | 1e wt % | 1f[5] wt % |
|---|---|---|---|---|---|---|
| sodium alkyl ether sulfate | 14.4% | 14.4% | | 9.2% | 5.4% | |
| linear alkylbenzene sulfonic acid | 4.4% | 4.4% | 12.2% | 5.7% | 1.3% | 22.0% |
| alkyl ethoxylate | 2.2% | 2.2% | 8.8% | 8.1% | 3.4% | 18.0% |
| amine oxide | 0.7% | 0.7% | 1.5% | | | |
| citric acid | 2.0% | 2.0% | 3.4% | 1.9% | 1.0% | 1.6% |
| fatty acid | 3.0% | 3.0% | 8.3% | | | 16.0% |
| protease | 1.0% | 1.0% | 0.7% | 1.0% | | 2.5% |
| amylase | 0.2% | 0.2% | 0.2% | | | 0.3% |
| lipase | | | | 0.2% | | |
| borax | 1.5% | 1.5% | 2.4% | 2.9% | | |
| calcium and sodium formate | 0.2% | 0.2% | | | | |
| formic acid | | | | | | 1.1% |
| amine ethoxylate polymers | 1.8% | 1.8% | 2.1% | | | 3.2% |
| sodium polyacrylate | | | | | 0.2% | |
| sodium polyacrylate copolymer | | | | 0.6% | | |
| DTPA[1] | 0.1% | 0.1% | | | | 0.9% |
| DTPMP[2] | | | 0.3% | | | |
| EDTA[3] | | | | | 0.1% | |
| fluorescent whitening agent | 0.15% | 0.15% | 0.2% | 0.12% | 0.12% | 0.2% |
| ethanol | 2.5% | 2.5% | 1.4% | 1.5% | | |
| propanediol | 6.6% | 6.6% | 4.9% | 4.0% | | 15.7% |
| sorbitol | | | | 4.0% | | |
| ethanolamine | 1.5% | 1.5% | 0.8% | 0.1% | | 11.0% |
| sodium hydroxide | 3.0% | 3.0% | 4.9% | 1.9% | 1.0% | |
| sodium cumene sulfonate | | | 2.0% | | | |
| silicone suds suppressor | | | 0.01% | | | |
| perfume | 0.3% | 0.3% | 0.7% | 0.3% | 0.4% | 0.6% |
| Basic Blue 21 | 0.013% | | | | | |
| Basic Violet 3 | | 0.001% | | | 0.0005% | |
| Basic Violet 4 | | | 0.005% | 0.003% | | 0.001% |

-continued

| Ingredient | 1a wt % | 1b wt % | 1c wt % | 1d wt % | 1e wt % | 1f[5] wt % |
|---|---|---|---|---|---|---|
| Acid Blue 7[4] | | 0.0003% | | | | |
| water | balance | balance | balance | balance | balance | balance |
| | 100.0% | 100.0% | 100.0% | 100.0% | 100.0% | 100.0% |

[1]diethylenetriaminepentaacetic acid, sodium salt
[2]diethylenetriaminepentakismethylenephosphonic acid, sodium salt
[3]ethylenediaminetetraacetic acid, sodium salt
[4]a non-tinting dye used to adjust formula color
[5]compact formula, packaged as a unitized dose in polyvinyl alcohol film

Example 2

The following granular detergent formulas are within the scope of the present invention.

| Ingredient | 2a wt % | 2b wt % | 2c wt % |
|---|---|---|---|
| Na linear alkylbenzene sulfonate | 3.4% | 3.3% | 11.0% |
| Na alkylsulfate | 4.0% | 4.1% | |
| Na alkyl sulfate (branched) | 9.4% | 9.6% | |
| alkyl ethoxylate | | | 3.5% |
| type A zeolite | 37.4% | 35.4% | 26.8% |
| sodium carbonate | 22.3% | 22.5% | 35.9% |
| sodium sulfate | 1.0% | | 18.8% |
| sodium silicate | | | 2.2% |
| protease | 0.1% | 0.2% | |
| sodium polyacrylate | 1.0% | 1.2% | 0.7% |
| carboxymethylcellulose | | | 0.1% |
| PEG 600 | | 0.5% | |
| PEG 4000 | | 2.2% | |
| DTPA | 0.7% | 0.6% | |
| fluorescent whitening agent | 0.1% | 0.1% | 0.1% |
| sodium perborate monohydrate | | | |
| sodium percarbonate | | 5.0% | |
| sodium nonanoyloxybenzenesulfonate | | 5.3% | |
| silicone suds suppressor | 0.02% | 0.02% | |
| perfume | 0.3% | 0.3% | 0.2% |
| Basic Blue 21[1] | 0.004% | | |
| Basic Blue 71[2] | | | 0.002% |
| Basic Violet 35[2] | | 0.006% | |
| water and miscellaneous | balance | balance | balance |
| | 100.0% | 100.0% | 100.0% |

[1]formulated as a particle containing 1% dye, 34% tallow alcohol(EO)25, 65% sodium sulfate & moisture
[2]formulated as a particle containing 0.5% dye, 99.5% PEG 4000

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of preparing a liquid laundry detergent composition, said liquid laundry detergent composition comprising (a) from about 5% to about 90%, by weight of the composition, of a surfactant, and (b) from about 0.0001% to about 0.05%, by weight of the composition, of a hueing dye selected from triarylmethane blue and violet basic dyes, methine blue and violet basic dyes, anthraquinone blue and violet basic dyes and mixtures thereof, said method comprising encapsulating the hueing dye, suspending the encapsulated dye in a structured liquid, and adding the suspension to a composition formulation containing a substantial portion of the balance of components of the liquid laundry detergent composition.

2. A method of preparing a solid laundry detergent composition, said solid laundry detergent composition comprising (a) from about 5% to about 90%. by weight of the composition, of a surfactant, and (b) from about 0.0001 % to about 0.05%. by weight of the composition, of a hueing dye selected from triarylmethane blue and violet basic dyes, methine blue and violet basic dyes, anthraquinone blue and violet basic dyes and mixtures thereof, said method comprising encapsulating the hueing dye, optionally including additional but not all components of the solid laundry detergent composition in the resulting encapsulate, and combining the hueing dye encapsulate with particulates containing a substantial balance of components of the solid laundry detergent composition.

* * * * *